US010893789B2

(12) United States Patent
Pisacane

(10) Patent No.: US 10,893,789 B2
(45) Date of Patent: Jan. 19, 2021

(54) LAMINATED FOAM MOPHEAD

(71) Applicant: Foamtec International Co., Ltd., Oceanside, CA (US)

(72) Inventor: Fred Pisacane, San Diego, CA (US)

(73) Assignee: Foamtec International Co., Ltd., Waco, TX (US)

( * ) Notice: Subject to any disclaimer, the term of this patent is extended or adjusted under 35 U.S.C. 154(b) by 111 days.

(21) Appl. No.: 15/295,794

(22) Filed: Oct. 17, 2016

(65) Prior Publication Data

US 2017/0027402 A1 Feb. 2, 2017

Related U.S. Application Data

(63) Continuation of application No. 11/401,686, filed on Apr. 10, 2006, now abandoned.

(60) Provisional application No. 60/669,557, filed on Apr. 8, 2005.

(51) Int. Cl.

| | |
|---|---|
| ***A47L 13/24*** | (2006.01) |
| ***A47L 13/144*** | (2006.01) |
| ***A47L 13/20*** | (2006.01) |

(52) U.S. Cl.

CPC ..... *A47L 13/24* (2013.01); *A47L 13/144* (2013.01); *A47L 13/20* (2013.01)

(58) Field of Classification Search

CPC ..... A47L 13/24; A47L 13/144; A47L 13/20

See application file for complete search history.

(56) References Cited

U.S. PATENT DOCUMENTS

| | | | | | |
|---|---|---|---|---|---|
| 3,406,420 | A * | 10/1968 | Siemund | A47L 1/06 | 15/121 |
| 3,783,469 | A | 1/1974 | Siemund | | |
| 4,050,111 | A * | 9/1977 | Mallory | A47L 1/06 | 15/105 |
| 4,604,767 | A * | 8/1986 | Burkhart | A47L 13/14 | 15/118 |
| 4,654,920 | A * | 4/1987 | O'Neil, Jr. | A47L 13/144 | 15/118 |
| 5,152,809 | A * | 10/1992 | Mattesky | A47L 17/08 | 51/295 |
| 5,371,914 | A * | 12/1994 | Mallory | A47L 1/06 | 15/121 |
| 5,528,791 | A * | 6/1996 | Wilson | A47L 13/144 | 15/119.2 |
| 5,864,913 | A * | 2/1999 | Robertson | A47L 1/06 | 15/121 |
| 5,865,551 | A * | 2/1999 | Lalli | A47L 13/22 | 15/119.2 |
| 5,987,685 | A | 11/1999 | Lambert | | |
| 7,629,043 | B2 | 12/2009 | Lindsay et al. | | |
| 2005/0150069 | A1* | 7/2005 | Specht | A47L 13/12 | 15/116.2 |

* cited by examiner

*Primary Examiner* — Dung Van Nguyen

(74) *Attorney, Agent, or Firm* — Zeman-Mullen & Ford, LLP

(57) ABSTRACT

A laminated foam mop head which includes a foam block having a top surface, a bottom surface, and two side surfaces, a fabric material laminated to the bottom and side surfaces of the foam block, and a bracket attached to the top surface of the foam block such that the bottom and side surfaces of the foam block are drawn upward and inward to form a mop head having an elliptical shaped cross section and the top surface of the foam block is pushed inward and not exposed.

9 Claims, 3 Drawing Sheets

LAMINATED FOAM MOPHEAD

CROSS-REFERENCE TO RELATED APPLICATIONS

This application is a continuation of U.S. Utility patent application Ser. No. 11/401,686, filed Apr. 10, 2006, currently pending, which application claims the benefit of, and priority to U.S. Provisional Application No. 60/669,557, filed Apr. 8, 2005, which applications are hereby incorporated by reference in their entireties.

FIELD OF INVENTION

The present invention is directed to a laminated foam mop head that is laminated with various fabrics without using glue or an adhesive in order to create a more durable foam mop head. More particularly, the present invention is directed to a laminated foam mop head that is laminated with a double-knit, snag-resistant polyester fabric or a micro fiber textile on all sides, except its ends, without using glue or an adhesive to create a durable, long lasting foam mop head.

BACKGROUND OF THE INVENTION

Mop heads made of foam have existed for sometime due to their ability to easily absorb and retain liquids during mopping. Such mop heads may be permanently attached to the end of a mop or they may be removable and replaceable. However, whether or not the foam mop heads are permanently attached or replaceable, minute particles and/or pieces of the foam mop heads become separated from the mop head over time during normal wearing of the mop head. As a result, the utility of the mop head decreases over time. In addition, the minute particles and/or pieces of the foam mop heads may result in further contamination of a site or space for which the mop is being used to clean. Accordingly, there is a need for a foam mop head with improved durability where particle removal that results from the wearing of the mop is decreased.

SUMMARY OF THE INVENTION

The present invention is directed to a laminated foam mop head having increased durability which results from decreasing particle removal of the mop head during wear by laminating the foam mop head with a fabric material without using glue or adhesive. Avoiding glue or adhesive as part of the lamination process further decreases potential contamination to the cleaning site that might result from the degradation of the glue or adhesive over time.

The laminated foam mop head includes a foam block having a top surface, a bottom surface, two side surfaces, and two end surfaces. A fabric material is laminated to the bottom surface and the side surfaces of the foam block. In one exemplary embodiment of the invention, the fabric material laminated to the bottom surface and side surfaces of the foam block comprises a double-knit, snag-resistant polyester fabric. In another exemplary embodiment of the invention, the fabric material laminated to the bottom surface and the side surfaces of the foam block comprises a micro fiber textile.

The laminated foam mop head of the present invention may be permanently attached to the end of a mop handle or alternatively, it may be removable and replaceable. The bottom and side surfaces of the foam block are laminated with the fabric material before installing a stainless steel bracket to the top surface of the foam block. The stainless steel bracket is attached to the top surface of the foam block such that the bottom and side surfaces of the foam block are pulled upward and inward such that a cross section of the laminated foam mop head has the general shape of an ellipse. Once the stainless steel bracket is completely attached, the top nonlaminated surface of the foam block is pushed completely inward and therefore is not exposed. The end surfaces of the foam mop head are not laminated.

DETAILED DESCRIPTION OF EXEMPLARY EMBODIMENTS

Figure 1:
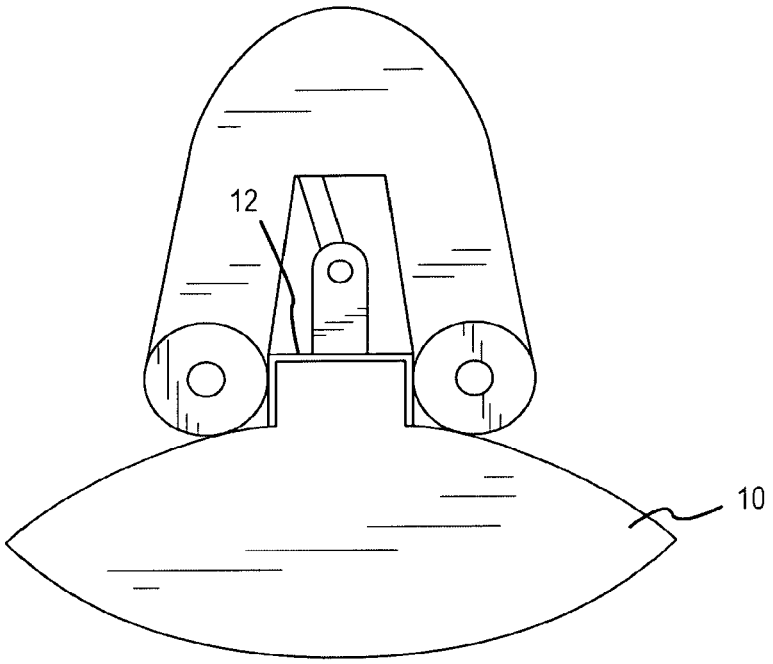
FIG. 1 is a side perspective view of a mop head in accordance with the invention.
Figure 3:
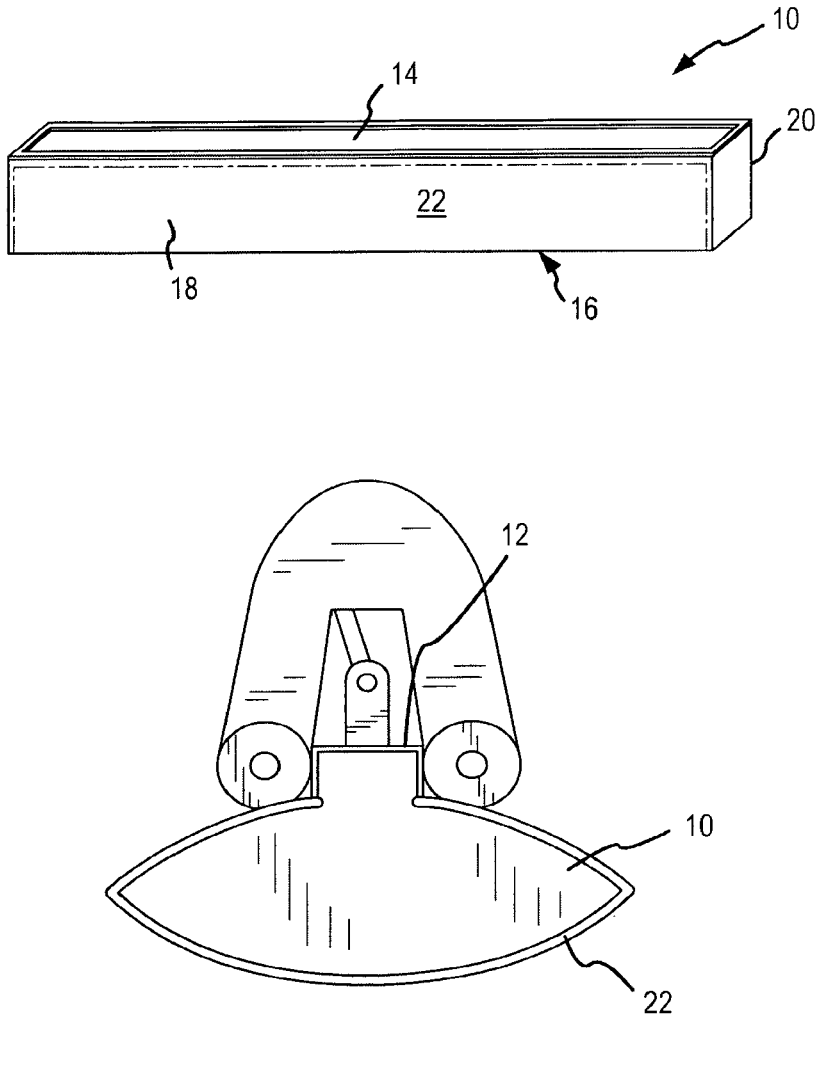
FIG. 3 is a schematic showing lamination with a micro-fiber on three sides of the mop head shown in FIG. 1 before installation of the stainless steel bracket shown in FIG. 1.

FIG. 1 is a side perspective view of a mop head 10 in accordance with the invention. FIG. 3 is a schematic showing lamination with a micro-fiber on three sides of the mop head shown in FIG. 1 before installation of the stainless steel bracket 12 shown in FIG. 1. Mop head 10 comprises a foam block having a top surface 14, a bottom surface 16, two side surfaces 18, and two end surfaces 20. At least one fabric material 22 is wrapped around, and laminated to the bottom surface 16 and side surfaces 18 of the foam block.

Figure 2:
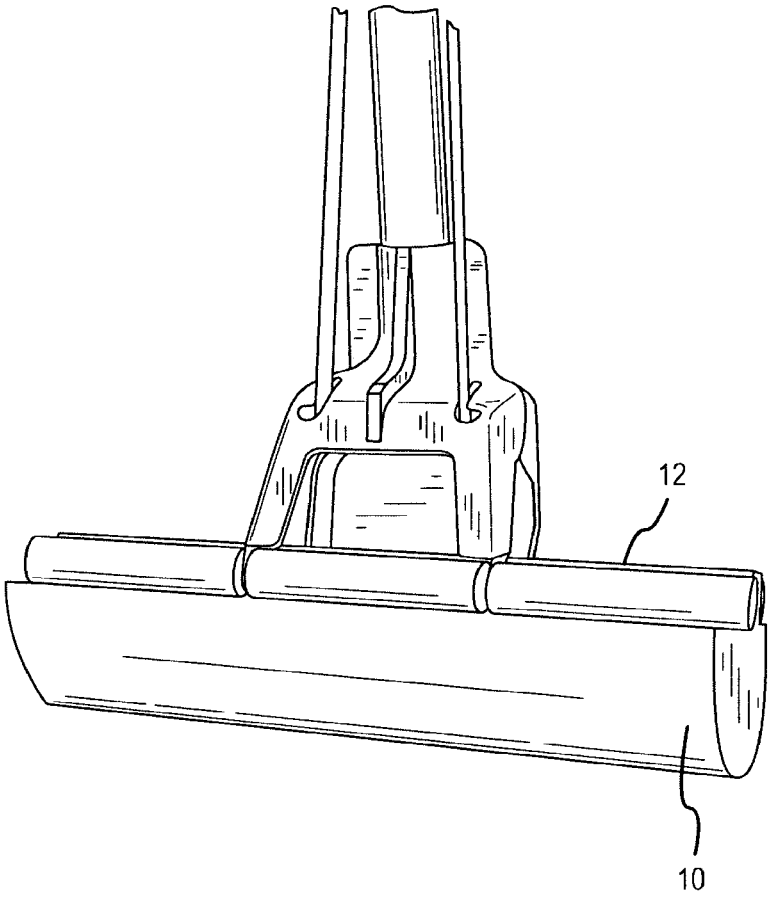
FIG. 2 is a front perspective view of the mop head shown in FIG. 1 (along with the handle portion of the mop) laminated with double-knit snag-resistant polyester fabric.

Fabric material 22 may be laminated to the bottom surface 16 and side surfaces 18 of the foam block by using any known means of uniting superimpose layers that does not include a glue or adhesive, such as, for example, heat and pressure applied to the superimposed layers. A stainless steel bracket (as shown in FIGS. 1 and 2) is attached to the top surface 14 of the foam block such that the bottom surface 16 and side surfaces 18 of the foam block are drawn upward and inward to form a mop head having a generally elliptical shaped cross-section. The longer sides of the top surface 14 of the foam block are tucked under the stainless steel bracket. Once the stainless steel bracket is attached, the top surface 14 of the foam block is pushed completely inward so that it is not exposed. The side surfaces 20 of the mop head are not laminated and have an elliptical shape after attachment of the stainless steel bracket.

In one exemplary embodiment, fabric material 22 that is laminated to the foam block comprises a double-knit snag-resistant polyester fabric that is laminated to the bottom surface and side surfaces of the foam block. In another exemplary embodiment, fabric material 22 that is laminated to the foam block comprises a micro fiber textile that is laminated to the bottom surface and side surfaces of the foam block. Lamination of the fabric material 22 to the bottom surface 16 and side surfaces 18 of the foam block without using glue reduces the creation of fine particles or pieces being worn from the foam mop head 10 and further reduces the chance of contaminating the site or space that is being cleaned with the foam mop head 10.

The invention claimed is:

1. A laminated foam mop head comprised of:

a foam block having a top surface, a bottom surface, and two side surfaces;

at least one fabric material laminated with heat and pressure along both the complete bottom and side surfaces of the foam block without using an adhesive such that the shape of the foam block after lamination retains its block shape; and a bracket comprised of a top member and two identical side members where the bracket is attached to the top surface of the foam block such that the bottom and side surfaces of the foam block are drawn upward and inward to form a mop head having an elliptical shaped cross section and the top surface of the foam block is pushed inward and not exposed.

2. The laminated foam mop head of claim 1 wherein the fabric material comprises a double-knit, snag-resistant, polyester fabric.

3. The laminated foam mop head of claim 1 wherein the fabric material comprises a micro fiber textile.

4. A laminated foam mop head comprised of:

a foam block having a top surface, a bottom surface, and two side surfaces;

at least one fabric material laminated to the complete bottom and side surfaces of the foam block; and a bracket having a top member, two side members, and an open bottom where the bracket is attached to the top surface of the foam block such that it forms a mop head having an elliptical shaped cross section with pointed edges such that a center point located between the two pointed edges is equidistant to the bottom surface of the foam block and a center of the open bottom of the bracket.

5. The laminated foam mop head of claim 4 wherein the fabric material comprises a double-knit, snag-resistant, polyester fabric.

6. The laminated foam mop head of claim 4 wherein the fabric material comprises a micro fiber textile.

7. A laminated foam mop head comprised of:

a foam block having a top surface, a bottom surface, two elongated side surfaces, and two end surfaces;

at least one fabric material laminated to the bottom and elongated side surfaces of the foam block; and a bracket attached to the top surface of the foam block such that the two end surfaces of the foam block form elliptical shapes having pointed ends such that a vertical distance from the pointed ends to the bottom of the foam block is about the same as a vertical distance to the bracket.

8. The laminated foam mop head of claim 7 wherein the fabric material comprises a double-knit, snag-resistant, polyester fabric.

9. The laminated foam mop head of claim 7 wherein the fabric material comprises a micro fiber textile.

* * * * *